United States Patent [19]

Demuth et al.

[11] Patent Number: 4,848,689

[45] Date of Patent: Jul. 18, 1989

[54] PACKAGE FORMER SUPPORT DEVICE

[75] Inventors: Robert Demuth, Nürensdorf; Daniel Hanselmann, Winterthur, both of Switzerland

[73] Assignee: Maschinenfabrik Rieter AG, Winterthur, Switzerland

[21] Appl. No.: 94,763

[22] Filed: Sep. 10, 1987

[30] Foreign Application Priority Data

Sep. 12, 1986 [CH] Switzerland ..... 03675/86

[51] Int. Cl.[4] ..... B65H 54/42; B65H 54/54

[52] U.S. Cl. ..... 242/18 DD

[58] Field of Search ..... 242/18 DD, 129.51, 68.4, 242/46.2, 46.3, 46.6, 46.21

[56] References Cited

U.S. PATENT DOCUMENTS

| | | | |
|---|---|---|---|
| 1,667,916 | 5/1928 | Williams | 242/68.4 |
| 2,250,675 | 7/1941 | Markle, Jr. | 242/129.51 |
| 2,776,098 | 1/1957 | Baumann et al. | 242/129.51 |
| 3,430,888 | 3/1969 | Lewis et al. | 242/68.4 |
| 3,433,433 | 3/1969 | Pospisil et al. | 242/129.51 |
| 3,596,845 | 8/1971 | Rajnoha et al. | 242/46.6 |
| 4,125,229 | 11/1978 | Dillon | 242/129.51 |
| 4,171,781 | 10/1979 | Kral et al. | 242/68.4 |
| 4,327,874 | 5/1982 | Bruno | 242/46.2 |
| 4,359,194 | 11/1982 | Buehler et al. | 242/46.3 |

FOREIGN PATENT DOCUMENTS

| | | |
|---|---|---|
| 231011 | 6/1986 | Czechoslovakia . |
| 0088708 | 9/1983 | European Pat. Off. . |
| 812270 | 5/1937 | France . |
| 1503330 | 10/1967 | France . |
| 2504104 | 10/1982 | France . |

OTHER PUBLICATIONS

Research Disclosure, Nr. 139, Nov. 1975, Seite 26 (p. 26). Zusammenfassung (Condensation of Disclosure) 13932, Industrial Opportunities Ltd., Havant, Hampshire, GB; "Spring Clip for Yarn Winding Chuck".

*Primary Examiner*—Stanley N. Gilreath
*Attorney, Agent, or Firm*—Werner W. Kleeman

[57] ABSTRACT

A package former support device or package tube support device for a double-armed cradle comprises a package tube support member which is provided with a detent or latching element which operatively engages or latches in an opening or notch in the package tube to prevent relative rotation between the package tube and the package tube support member.

11 Claims, 4 Drawing Sheets

PACKAGE FORMER SUPPORT DEVICE

BACKGROUND OF THE INVENTION

The present invention relates to a new and improved construction of a package former support device or package tube support device for a double-armed cradle of a yarn winding assembly or unit.

Such assemblies or units are used in textile machines, for example back-winding machines, rotor and other open-end spinning machines and false twist texturizing machines, as disclosed in the commonly assigned European Published patent application No. 0,199,245, published Oct. 29, 1986, the disclosure of which is incorporated herein by reference.

SUMMARY OF THE INVENTION

It is a primary object of the present invention to provide a new and improved construction of a package tube support device which allows donning of a package tube thereon in a highly reliable, exact and efficient manner.

Another important object of the present invention, aims at the provision of a new and improved construction of a package tube support device for a textile machine, especially, although not exclusively, for a double-arm cradle of a yarn winding assembly, which package tube support device is relatively simple in construction and design, highly reliable in operation, quite economical to manufacture, not readily subject to breakdown or malfunction, requires a minimum of maintenance and servicing and affords exact and positive donning and positioning of a package tube on the package tube support device with relative ease.

Now in order to implement these and still further objects of the present invention, which will become more readily apparent as the description proceeds, the package former support device or package tube support device of the present development is of the type comprising a package tube support member which is provided with at least one element on a portion of the package tube support member which projects into the package tube. The at least one element is movable between two predeterminate positions. In the first position thereof, the at least one element projects beyond a surface receiving the package tube, while in the second position the at least one element is forced back from the first position at least to an extent such that it does not prevent contact between the tube and the tube-receiving surface. Means are provided to urge the at least one element resiliently towards the first position.

A package tube which in use is mounted by the package tube support device in the double-arm cradle of the yarn winding assembly or apparatus can be provided with an opening or notch or equivalent structure at a position such that, upon relative rotation occurring between the package tube and the package tube support member, the at least one element positively engages into the opening or notch during one revolution of these parts relative to each other and thus prevents further relative rotation of those parts.

The opening or notch can be formed by a cutout or cutaway portion in the package tube end. More than one such opening or notch can be provided in the package tube end, but a package tube with only a single opening or notch is preferred.

The package tube support member of the package former support device or package tube support device can also be fitted with more than one element. The dimension of each such element defining a detent or latching element in the circumferential direction of the package tube support member (also in relation to the package tube) is preferably small in relation to or a minor fraction of the circumference itself. A surface on the detent or latching element, which surface engages the package tube, can be formed as an inclined surface (inclined to the direction of movement of the detent or latching element between the aforementioned two positions respectively defining an engagement position and a retracted position).

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
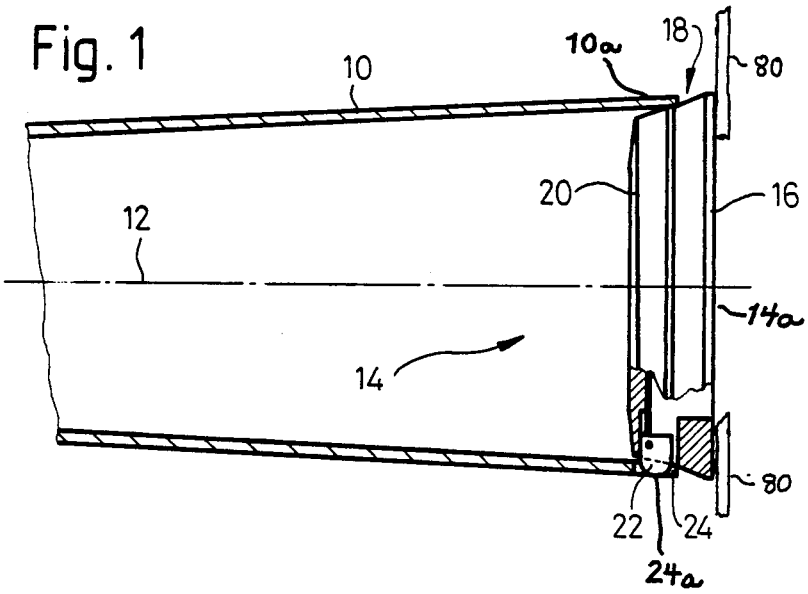
FIG. 1 shows a cross-section through an end portion of a package tube and a package tube support member of the package former support device or package tube support device and on which the package tube is mounted.

Describing now the drawings, it is to be understood that to simplify the showing thereof, only enough of the structure of the package former support device or package tube support device 14 and its related package tube 10 supported thereat and used in conjunction with a suitable textile machine has been illustrated therein as is needed to enable one skilled in the art to readily understand the underlying principles and concepts of the present invention. Turning now specifically to FIG. 1 of the drawings, the package former support device or package tube support device 14 illustrated therein by way of example and not limitation, will be seen to mount thereon a package tube 10 or the like as illustrated in such FIG. 1. This package tube 10 is substantially conical and serves in use as a package former for a conical thread or yarn package (not shown) which is formed as a cross-wound package during rotation of the package tube 10 about its longitudinal or lengthwise axis 12. Only the package tube end portion or end edge 10*a* having the larger diameter is conveniently illustrated in FIG. 1 to simplify the showing of the drawings.

This package tube end portion or end edge 10*a* is mounted on a tube-receiving part or member, defining a package tube support member 14*a*, of the package tube support device 14. The package tube support device 14 is rotatably mounted on a "right-hand" arm of a double-armed cradle, generally schematically indicated in FIG. 1 by reference numeral 80; both the arm and the cradle itself are well known and are therefore not further illustrated, although reference may be readily made, for instance, to the aforementioned commonly assigned European Published patent application No. 0,199,245, published Oct. 29, 1986 and the likewise commonly assigned U.S. Pat. No. 4,598,881, granted July 8, 1986, which disclose exemplary types of double-armed cradles. The rotatable mounting of the "right-hand" package tube support device 14 enables the previously mentioned rotation of the package tube 10 (and the thread or yarn package located thereon) about the longitudinal or lengthwise axis 12. A similar (non-illustrated) "left-hand" package tube support device 14 is rotatably mounted on the other arm of the double-armed cradle 80 and receives the non-illustrated oppositely situated smaller tube end portion.

The two arms of the double-armed cradle 80 are mounted on a non-illustrated yoke and are therefore pivotable about a common, non-illustrated cradle axis. By means of a pivoting motion of the double-armed cradle 80, therefore, a package tube 10 carried by the arms of the double-armed cradle 80 can first be brought into contact with a non-illustrated but conventional friction drive roll or roller or the like as such is well known and conventionally used in this technology. The driven friction roll or roller rotates about its own, stationary longitudinal axis and thereby drives the package tube 10 around the tube axis or longitudinal axis 12 to enable formation of the package windings. As the thread or yarn package builds up between the friction roll or roller and the package tube 10, the double-armed cradle 80 pivots around the cradle axis to enable movement of the package tube 10 away from the friction roll or roller. During this pivoting movement of the double-armed cradle 80, the surface of the thread or yarn package remains in contact with the drive-imparting friction roll or roller until the thread or yarn package has been fully wound.

The right-hand package tube support device 14 comprises the package tube support member 14*a*, here shown by way of example as a disk or plate-like element 16 provided with a substantially conical surface or portion 18 facing towards the package tube 10. This conical surface or portion 18 carries an extension or protuberant portion 20 which projects into the package tube 10 when the latter is mounted in the double-armed cradle 80, so that the end portion or edge 10*a* of the package tube 10 engages the conical surface 18. The left-hand package tube support device 14 is similarly formed.

In theory, the tube axis or longitudinal axis 12 should be aligned with the non illustrated axes of the bearing units carrying the package tube support devices 14. In practice, this happens infrequently. It is very difficult to adjust the two arms of the double-armed cradle 80 and their bearing units, carrying respective package tube support devices 14, precisely relative to each other. It is still more difficult to ensure that the package tube 10 is mounted coaxially with the two package tube support devices 14, especially when the package tube 10 itself is no longer new and its end edges or portions have been damaged.

Furthermore, in theory, the tube axis or longitudinal axis 12 should be so aligned relative to the non-illustrated axes of the double-armed cradle 80 and the friction roll or roller that "line contact" arises between the package tube 10 (or a thread or yarn package supported thereby) and the friction roll or roller. It is already difficult to achieve this result in winding a cylindrical thread or yarn package - in winding of a conical thread or yarn package the theoretical conditions occur even less frequently.

If practice coincided with theory, it would be sufficient to press the arms of the double-armed cradle 80 towards each other (for example as shown in the aforementioned commonly assigned European Published patent application No. 0,199,245 and the corresponding U.S. patent application Ser. No. 843,172 filed Mar. 24, 1986, now U.S. Pat. No. 4,718,615) to create a perfect frictional connection between the package tube support devices 14 and the package tube 10.

Then, no relative rotation would arise between the package tube support devices 14 and the package tube 10 or the like. In practice, such relative rotation arises frequently and the speed of relative rotation can correspond, for example to $\pm 1.5\%$ of the delivery speed of the thread or yarn or the like. The surfaces of the package tube support devices 14 engaging the package tubes 10 must then be made of wear-resistant material, which is expensive. Still greater disadvantages arise if the thread or yarn or the like is intended to be clamped between a package tube support device (for example the right-hand package tube support device 14) and the tube portion carried thereby (for example, in accordance with the aforementioned commonly assigned U.S. Pat. No. 4,598,881, granted July 8, 1986).

In accordance with this invention, relative rotation of this type is prevented by creating interengagement or positive latching or form-locking connection between at least one package tube support device (in the example, the right-hand package tube support device 14) and the tube portion carried thereon. For this purpose, the package tube support device 14, and specifically the package tube support member 14*a* is provided with a detent or latching element 22 or equivalent structure and the package tube 10 has in its here depicted larger end portion 10*a* an opening or recess or notch 24 or equivalent structure to receive this detent or latching element 22. In its most simple form, the package tube 10 is provided with a cutout or cutaway portion 24*a* (for example of rectangular form) in its end portion or edge 10*a*. The detent or latching element 22 can project into the cutout or cutaway portion 24*a* from the surface 18 and/or the extension 20.

The detent or latching element 22 and the cutout or cutaway portion 24*a* should be so dimensioned that the detent or latching element 22 can be received without difficulty in the cutout or cutaway portion 24*a*, but that contact between the detent or latching element 22 and one longitudinal side of the cutout or cutaway portion 24*a* arises if relative rotation occurs between the package tube support device 14 and the package tube 10 after the detent or latching element 22 has been positioned in the cutout or cutaway portion 24*a*. The detent or latching element 22 (and therefore the cutout or cutaway portion 24*a*) are preferably made as narrow as possible in the circumferential direction, provided, however, that adequate strength and rigidity are maintained.

The detent or latching element 22 could clearly be fixedly secured to the package tube support member 14*a* of the package tube support device 14 or could even be made rigidly integral therewith. However, in that case, each time a package tube 10 is donned in the double-armed cradle 80, care must be taken to ensure that the detent or latching element 22 and the cutout or cutaway portion 24*a* are aligned with each other. It is preferable to adopt an arrangement in which such care is unnecessary; various examples of a correspondingly formed or constructed package tube support device and detent or latching element will now be described with reference to FIGS. 2 to 10. It will be understood that while as a matter of convenience such description will be made with respect to one of the package tube support devices 14 for one end of the associated package tube 10 the other non-illustrated package tube support device 14 is correspondingly constructed.

Figure 2:
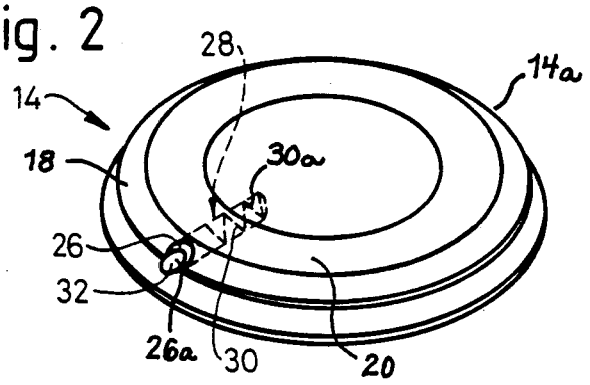
FIG. 2 is a perspective view depicting an embodiment of a package tube support device constructed according to the present invention.

In the embodiment of FIG. 2, the detent or latching element is in the form of a short pin or plunger 26 or equivalent displaceable detent or latching element, for example formed of any suitable metal or plastics. The pin or plunger 26 is movable in radial directions in a radial bore 28 in the associated package tube support device 14. The bore 28 bridges the connection between the conical surface 18 and the extension 20. The pin or plunger 26 is biased radially outwardly by a suitable resilient means 30 (diagrammatically indicated), such as a spring 30*a*, and is held in a first or ready position by a positioning means (for example a non-illustrated abutment). In this ready position (FIG. 2), the free end 26*a* of the pin or plunger 26 projects out of the bore 28. The end face of this free end 26*a* of the pin or plunger 26 forms an inclined surface 32 which is directed towards the left-hand arm and coacting package tube support device 14 (see also FIG. 3).

During donning of a package tube 10 provided with a cutout or cutaway portion 24*a*, there are now two possibilities:

(a) The cutout or cutaway portion 24*a* is by chance aligned in the axial direction with the pin or plunger 26. The surface 32 therefore does not come into contact with the package tube 10 and the pin or plunger 26 remains in the ready position relative to the package tube support member 14*a* of the package tube support device 14.

(b) The cutout or cutaway portion 24*a* is not aligned with the pin or plunger 26. The end portion or edge 10*a* of the package tube 10 first engages the inclined surface 32 and forces the pin or plunger 26 back into the bore 28 against the action of the resilient means 30 (the spring characteristic must be correspondingly selected), whereupon the end portion or edge 10*a* of the package tube 10 engages the surface 18.

In both cases, there are now further possibilities, namely:

(i) The friction or frictional connection between the package tube 10 and the package tube support member 14*a* of the package tube support device 14 suffices to transfer the drive moment to the package tube 10.

(ii) The friction or frictional connection is inadequate for this purpose.

In the two cases (a) (i) and (b) (i), the pin or plunger 26 remains during package formation in the position relative to the package tube 10 which it adopted during donning. Under these conditions, no transfer of forces arises via the detent or latching element defined by the pin or plunger 26.

In case (a) (ii), the pin or plunger 26 engages one of the longitudinal sides (axially extending sides) of the cutout or cutaway portion 24*a*, as soon as the inadequate friction or frictional connection between the package tube 10 and the package tube support member 14*a* of the package tube support device 14 leads to a relative rotation between those parts. The direction of this rotation, and hence the longitudinal side of the cutout or cutaway portion 24 engaged by the detent or latching element constituted by the pin or plunger 26, can vary in dependence upon the circumstances. In any event, the relative rotation is stopped immediately upon engagement of the detent or latching element defined by the pin or plunger 26 with one of the longitudinal sides.

On the other hand, in case (b) (ii), there is initially nothing to prevent relative rotation between the package tube 10 and the package tube support member 14*a* of the package tube support device 14. However, after at most approximately one relative revolution between the package tube 10 and the package tube support member 14*a* of the package tube support device 14, the pin or plunger 26 comes into alignment with the cutout or cutaway portion 24*a*. The resilient means 30 then again presses the pin or plunger 26 radially outwardly so that it projects into the cutout or cutaway portion 24*a* and thereby prevents further relative rotation of the package tube 10 and the package tube support member 14*a* of the package tube support device 14.

Clearly, the outermost or free end 26*a* of the pin or plunger 26 preferably is not pressed radially outwardly to such an extent that it projects beyond the outer conical surface of the package tube 10, because otherwise the pin or plunger 26 comes into contact with the friction roll or roller during each revolution of the package tube 10 until the thread or yarn package has built up to form a gap between the tube and the friction roller.

Figure 3:
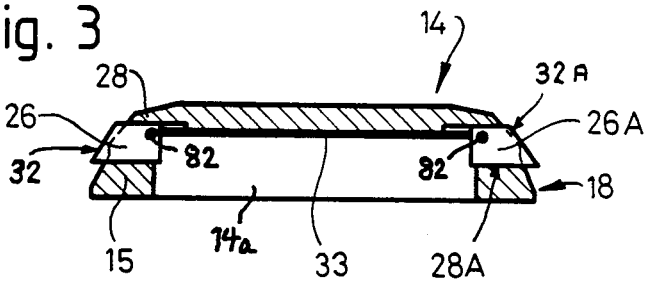
FIG. 3 is a cross-sectional view of a further modified embodiment of a package tube support device constructed according to the present invention.

FIG. 3 shows a preferred embodiment of a package tube support device 14 in accordance with FIG. 2. The package tube support member 14*a* of the package tube support device 14 is hollowed out to a substantially dish-shape so that the surface or conical surface 18 is provided on a flange or flange portion 15 of the package tube support member 14*a*. This package tube support device 14 has the package tube support member 14a thereof provided with two pins or plungers 26, 26A or equivalent detent or latching structure located in respective bores 28, 28A in flange 15. The axes of the bores 28, 28A are approximately aligned.

Each pin 26, 26A has a transverse bore 82 adjacent its inner end, and a resilient element or means in the form of, for instance, a wire ring 33 extends through these transverse bores 82. During assembly of the package tube support device or unit 14, the wire ring 33 is pressed together in its circumferential direction and exerts a spring force upon the pins or plungers 26, 26A in order to urge them radially outwardly. The outward movement of the pins or plungers 26, 26A is limited by the engagement of the wire ring 33 itself with the internal or inner surface of the flange or flange portion 15. The wire ring 33 therefore acts as both a resilient means and a positioning abutment.

The wire ring 33 yields or gives in the radially inward direction if the pins or plungers 26, 26A are pressed inwards by the package tube 10. However, the wire ring 33 presses one pin outwardly again as soon as it is released by the package tube 10, that is when it has been brought into alignment with the cutout or cutaway portion 24a through relative rotation of the package tube support member 14a of the package tube support device 14 and the package tube 10. Since two pins or plungers 26, 26A are provided, at most approximately a half-revolution is necessary in order to bring one of these two pins or plungers 26, 26A into coincidence or coacting association with the cutout or cutaway portion 24a.

Figure 4:
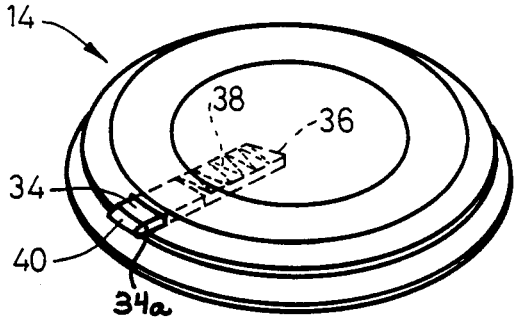
FIG. 4 is a perspective view depicting another embodiment of a package tube support device constructed according to the present invention.
Figure 4A:
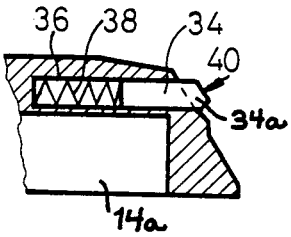
FIG. 4A is a fragmentary cross-sectional detailed view of the embodiment of package tube support device depicted in FIG. 4.

FIGS. 4 and 4A show an embodiment comprising a single detent or latching element in the form of a bar or bar member 34 which can move to and fro in a radial groove 36 in package tube support member 14a of the package tube support 14. The bar or bar member 34 is pressed radially outwardly by a compression or pressure spring 38 and its end portion 34a is formed as an inclined surface 40. The mode of operation is basically exactly as described with reference to the embodiment depicted in FIG. 2 and thus need not be here further considered.

Figure 5:
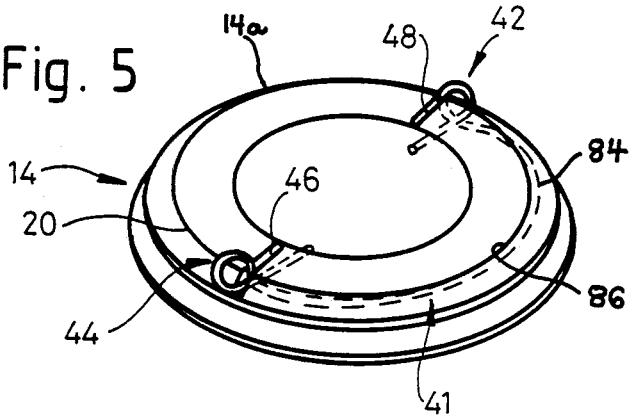
FIG. 5 is a perspective view depicting still another embodiment of a package tube support device constructed according to the present invention.

FIG. 5 shows a double detent or latching element in the form of a wire spring 84 with bent end portions 42, 44. The wire spring 84 is deformed to an arc or curved portion 41 which is received by the dish-shaped hollow or hollow portion 86 provided in the package tube support member 14a of the package tube support device 14. Each end portion 42, 44 has a first curvature so that these portions lie in a plane disposed at substantially right angles to the previously mentioned arc or curved portion 41. In addition, each end portion 42, 44 has a second curvature so that the wire spring 84 forms a small ring in the previously mentioned plane.

The extension 20 of the package tube support member 14a of the package tube support device 14 is provided with two slots or slot members 46, 48 through which respective end portions 42, 44 project outwardly. The mode of operation of this embodiment is in principle the same as that of FIG. 3 and therefore will not be further described.

Figure 6:
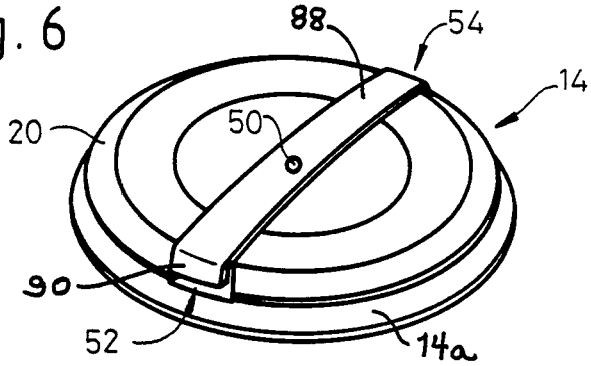
FIG. 6 is a perspective view depicting yet still another embodiment of a package tube support device constructed according to the present invention.
Figure 7:
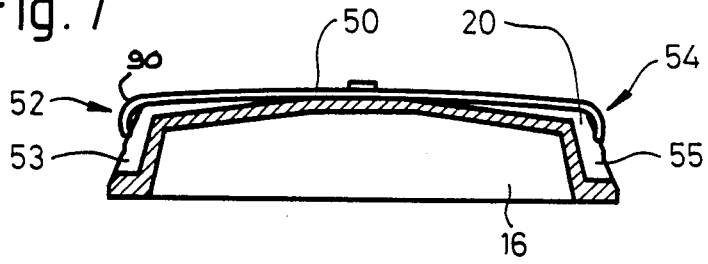
FIG. 7 is a cross-sectional view of embodiment of the package tube support device depicted in FIG. 6.

FIGS. 6 and 7 show a further embodiment comprising as the detent or latching element a flat spring 88 having a middle portion 50 which is secured by any suitable and thus not illustrated attachment means to the central part of the package tube support member 14a of the package tube support device 14, and two end portions 52, 54 each of which is bent to a hook-shape 90 overlying the extension 20. These end portions 52, 54 can be pressed back into respective grooves 53, 55 if the package tube 10 covers both grooves 53, 55. However, if a cutout or cutaway portion 24a in the package tube 10 coincides with a groove 53 or 55, the corresponding end portion 52 or 54 moves outwardly and engages in the cutout or cutaway portion 24a.

Figure 8:
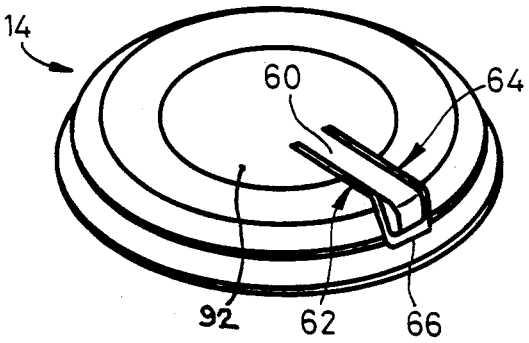
FIG. 8 is a perspective view depicting another embodiment of a package tube support device constructed according to the present invention.
Figure 8A:
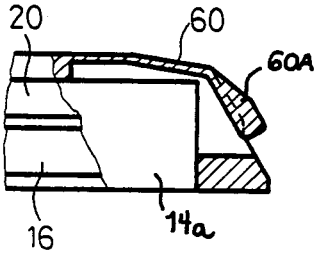
FIG. 8A is a fragmentary cross-sectional detailed view of the embodiment of package tube support device depicted in FIG. 8.

In the example shown in FIGS. 8 and 8A, the resilient means or element is not provided in the form of a separate element but is formed by an integral part 60 of the package tube support member 14a of the package tube support device 14 itself i.e. formed of one-piece with the package tube support member 14a. By means of two radial slots 62, 64 and a further connecting slot 66 in the support flange or flange member 92 of the package tube support member 14a, an elastically bendable or resilient "finger" 60 is formed. The end portion of this finger 60 has an enlargement 60A in the radially outward direction, this enlargement 60A serving as the detent or latching element.

Figure 10:
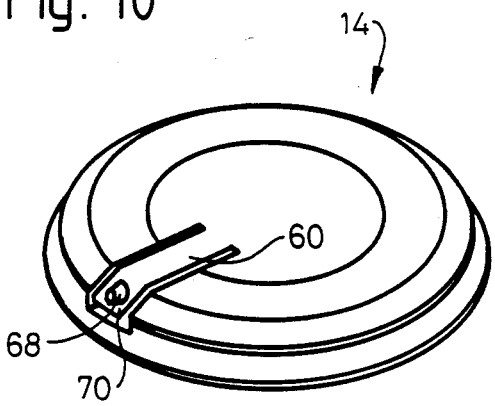
FIG. 10 is a perspective view depicting yet another embodiment of a package tube support device constructed according to the present invention.
Figure 10A:
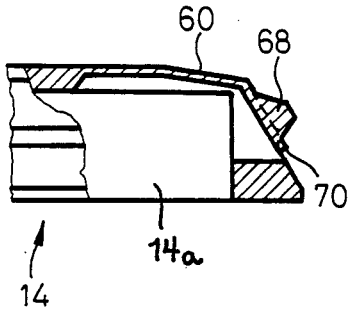
FIG. 10A is a fragmentary cross-sectional detailed view of the embodiment of package tube support device depicted in FIG. 10.

Turning at this point briefly to the modified example shown in FIGS. 10 and 10A such is substantially the same that depicted in FIGS. 8 and 8A, but the detent or latching element is, in this case, formed by a small pin or projection 68 instead of by an enlargement of the finger end portion 70, of the finger 60 which is an integral or one-piece part of the package tube support member 14a of the package tube support device 14.

Figure 9:
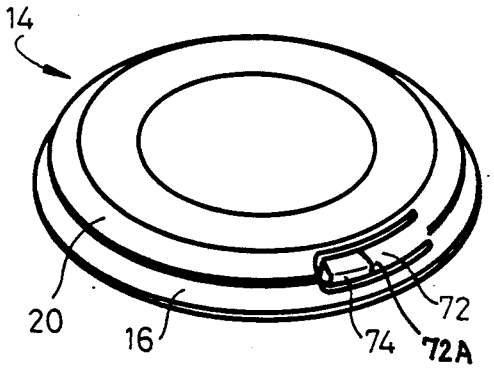
FIG. 9 is a perspective view depicting still another embodiment of a package tube support device constructed according to the present invention.
Figure 9A:
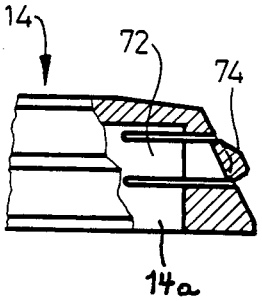
FIG. 9A is a fragmentary cross-sectional detailed view of the embodiment of package tube support device depicted in FIG. 9.

In the embodiment shown in FIGS. 9 and 9A, the principle involved is similar to that described for FIGS. 8 and 8A, with an integral elastic finger or finger member 72 and an enlargement 74 provided at the finger end portion 72A. In this case, however, the elastic finger or finger member 72 extends in the circumferential direction instead of the radial direction.

The detent or latch-receiving opening or recess or notch 24 is not necessarily in the form of a cutout or cutaway portion 24a and does not necessarily extend up to the end portion or edge 10a of the package tube 10.

The preferred form of resilient means for urging the detent or latching element towards the operative or engagement position (in which it is interengaged with a cutout or cutaway portion 24a if a package tube 10 is in place), comprises an elongate, resiliently-bendable element extending in the radial direction (FIGS. 6–8 and 10) or in the circumferential direction (FIGS. 3, 5 and 9). In particular, this resilient element is preferably made integral with the body or package tube support member 14a of the package tube support device 14 (generally, a disk structure) so that the package tube support device 14 (including the resilient element) can be manufactured, for example by molding, in a single manufacturing step without additional assembly operations becoming necessary.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. The combination of a package tube support device and a package tube for a double-armed cradle of a yarn winding assembly, comprising:

a package tube support member provided with a portion which is capable of projecting into and supporting a package tube when mounted on said package tube support member;

at least one element provided for said package tube support member;

said at least one element being defined by an elastically movable portion of the package tube support member which is integrally formed in one piece therewith;

a package tube provided with at least one opening in the region associated with said package tube support member in the donned state of said package tube on said package support member;

said at least one element on said portion of the package tube support member capable of projecting into and supporting the package tube, being elastically movable between an engagement position for positively interengaging with said opening of the package tube and a retracted position where said at least one element enables the package tube to be donned on the package tube support member;

said at least one element, in the donned state of said package tube on said package tube support member, selectively assuming either one of (i) said engagement position in the event of alignment between said at least one element and said at least one opening in said package tube or (ii) said retracted position in the event of non-alignment between said at least one element and said at least one opening in said package tube;

said package tube, in the donned state on said package tube support member, and said package tube support member being rotatable relative to each other for aligning said at least one opening in said package tube with said at least one element at said package tube support member; and said at least one element, upon alignment with said at least one opening in said package tube, being elastically moved into said engagement position for positively entraining the package tube along with the package tube support member during a yarn winding operation.

2. The combination as defined in claim 1, wherein:

said at least one element includes a surface engaging into the at least one opening of the package tube during one revolution of the package tube support member and said package tube relative to one another, to thereby prevent further relative rotation of said package tube support member and said package tube; and said surface comprising an inclined surface which is inclined with respect to a predeterminate direction of movement of the at least one element between said engagement position and said retracted position and is directed towards the package tube to be supported.

3. The combination as defined in claim 1, wherein:

said package tube support member has a circumference and a circumferential direction; and said at least one element having a dimension in the circumferential direction of the package tube support member which is relatively small in relation to the circumference of the package tube support member.

4. The combination as defined in claim 1, wherein:

said package tube support member has a circumference and a circumferential direction; and said at least one element having a dimension in the circumferential direction of the package tube support member which is a minor fraction of the circumference of the package tube support member.

5. The combination as defined in claim 1, wherein:

said at least one element comprises a plurality of said elements provided for the package tube support member.

6. The combination as defined in claim 5, wherein:

said plurality of elements comprise at least two said elements arranged in spaced relationship from one another at diametrically opposite locations at said package tube support member;

said package tube comprising at least two diametrically oppositely situated openings; and said at least two elements and said at least two openings being positively interengageable during one-half revolution of said package tube and said package tube support member relative to one another in the donned state of said package tube in order to positively interconnect said package tube support member and said package tube and thus to prevent further relative rotation between said package tube support member and said package tube.

7. The combination of a package tube support device and a package tube, comprising:

a package tube support member provided with a portion which is capable of projecting into and supporting the package tube when mounted on said package tube support member;

at least one element provided for said package tube support member;

said at least one element being defined by an elastically movable portion integrally formed in one piece with the package tube support member;

said at least one element being movable on said portion of the package tube support member capable of projecting into and supporting the package tube, between an engagement position serving to entrain the package tube along with said package tube support member and a retracted position where said at least one element enables the package tube to be donned on the package tube support member; and said package tube being provided with an opening at a position such that, upon relative rotation of the package tube support member and the package tube, said at least one element projects into said opening during one revolution of the package tube support member and said package tube relative to each other, and thereby prevents further relative rotation of said package tube support member and said package tube.

8. The combination as defined in claim 7, wherein:

said package tube has a package tube end; and said opening being formed as a cutaway portion in said package tube end.

9. The combination of a package tube support device and a package tube for a double-armed cradle of a yarn winding assembly, comprising:

a package tube support member containing at least one elastically movable element integrally formed in one piece with said package tube support member and structured such that said package tube support member can effect a form-locking connection by positive interengagement of said one-piece elastically movable element with an opening of the package tube carried by the package tube support member.

10. The combination of a package tube support device and a package tube for a double-armed cradle of a yarn winding assembly, comprising:

a package tube support member for supporting a package tube when mounted on said package tube support member; and said package tube support member containing at least one elastically movable element integrally formed in one piece with said package tube support member and structured such that said package tube support member can effect a form-locking connection by positive interengagement of said one-piece elastically movable element with an opening of the package tube carried by the package tube support member.

11. The combination of a package tube support device and a package tube, comprising:

a package tube support member provided with a portion which is capable of projecting into and supporting the package tube when mounted on said package tube support member;

said package tube support member having a circumferential direction;

at least one element provided for said package tube support member;

said at least one element being defined by an elastically movable portion integrally formed in one piece with the package tube support member;

said at least one element having a dominant portion thereof extending in the circumferential direction of said package tube support member for guidance of the package tube during relative rotation between the package tube and the package tube support member;

said at least one element being elastically movable between an engagement position serving to positively interengagingly entrain the package tube along with said package tube support member and a retracted position where said at least one element enables the package tube to be donned on the package tube support member; and said package tube being provided with an opening at a position such that, upon relative rotation of the package tube support member and the package tube, said at least one element projects into said opening in positive interengagement therewith during one revolution of the package tube support member and said package tube relative to each other, and thereby prevents further relative rotation of said package tube support member and said package tube.

* * * * *